US009516427B2

(12) United States Patent
Akino

(10) Patent No.: US 9,516,427 B2
(45) Date of Patent: Dec. 6, 2016

(54) ELECTRODE EXTRACTION TERMINAL FOR UNIDIRECTIONAL CONDENSER MICROPHONE UNIT AND UNIDIRECTIONAL CONDENSER MICROPHONE UNIT

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKI KAISHA AUDIO-TECHNICA, Machida-Shi, Tokyo (JP)

( * ) Notice: Subject to any disclaimer, the term of this patent is extended or adjusted under 35 U.S.C. 154(b) by 1 day.

(21) Appl. No.: 14/476,231

(22) Filed: Sep. 3, 2014

(65) Prior Publication Data

US 2015/0201264 A1 Jul. 16, 2015

(30) Foreign Application Priority Data

Jan. 10, 2014 (JP) ..... 2014-003309

(51) Int. Cl.
*H04R 19/04* (2006.01)
*H04R 1/34* (2006.01)

(52) U.S. Cl.
CPC ..... *H04R 19/04* (2013.01); *H04R 1/342* (2013.01)

(58) Field of Classification Search
USPC ..... 381/355
See application file for complete search history.

(56) References Cited

U.S. PATENT DOCUMENTS 8,588,451 B2 * 11/2013 Matsunaga ..... H04R 19/016 381/174
2008/0101630 A1 * 5/2008 Akino ..... H04R 19/04 381/190

FOREIGN PATENT DOCUMENTS

JP 2007-300268 A 11/2007

* cited by examiner

*Primary Examiner* — Amir Etesam
(74) *Attorney, Agent, or Firm* — Manabu Kanesaka

(57) ABSTRACT

An electrode extraction terminal extracting a generated current by contacting with a fixed electrode is disposed inside a unit case, and can change from a cardioid to a hyper cardioid. The electrode extraction terminal includes an electrode rod portion having a projection portion at a tip side; and a pedestal portion having a flat surface surrounded by a peripheral wall portion having a sitting height thereof same as that of the projection portion of the electrode rod portion, and facing the fixed electrode under a shape with a size showing a cardioid in directivity, wherein the flat surface is located orthogonal to an axis direction of the electrode rod portion. In a peripheral surface area of one or more sound holes of the flat surface, a minute concave-convex surface is provided to reduce an acoustic resistance value to show a hyper cardioid in directivity.

9 Claims, 6 Drawing Sheets

ELECTRODE EXTRACTION TERMINAL FOR UNIDIRECTIONAL CONDENSER MICROPHONE UNIT AND UNIDIRECTIONAL CONDENSER MICROPHONE UNIT

BACKGROUND OF THE INVENTION AND RELATED ART STATEMENT

The present invention relates to an electrode extraction terminal for a unidirectional condenser microphone unit and a unidirectional condenser microphone unit. More specifically, the present invention is a technology relating to the electrode extraction terminal for a unidirectional condenser microphone unit which can easily change a directivity of a small lot member for a cardioid into that for a hyper cardioid, and the unidirectional condenser microphone unit comprising the electrode extraction terminal.

A condenser microphone unit is formed such that a vibration plate vibrating by a sound wave is opposed to a fixed pole through a spacer so as to have a function as a condenser which can change an electrostatic capacity according to a degree of a vibration of the vibration plate.

In that case, a specific structure of the condenser microphone unit is formed to have, for example, a structure shown in FIG. 8 of the application, wherein FIG. 3 of Japanese Patent Application Publication No. 2007-300268 is depicted. Namely, according to this figure, a condenser microphone unit 100 is formed as a whole by housing, a vibration plate 120 stretched in a diaphragm ring 121; a fixed pole 130 with sound holes 131 opposed to the vibration plate 120 by disposing a spacer which is not shown in the figure between the fixed pole 130 and the vibration plate 120; a pedestal (an insulation seat) 133 supporting a marginal portion of the fixed pole 130; an electrode extraction terminal 135 integrally combined with the pedestal (the insulation seat) 133; and a lock ring 136 screwed to a female screw of a unit case 101, inside the unit case 101 including a front acoustic terminal 102 on a front end face.

Specifically, the pedestal 133 made of an insulation material and the electrode extraction terminal 135 made of a conductive metal material in FIG. 8 are mutually formed as separate bodies, and are disposed inside the unit case 101 by integrally combining the pedestal 133 and the electrode extraction terminal 135.

Meanwhile, in using a microphone, there is also a case wherein it is more preferable that the directivity shows the hyper cardioid than the cardioid depending on a situation of collecting sound, and in order to meet such demand, there is proposed a condenser microphone of the Japanese Patent Application Publication No. 2007-300268.

Namely, the condenser microphone of the Japanese Patent Application Publication No. 2007-300268 has been proposed based on a point that if a distance between a front acoustic terminal and a back acoustic terminal becomes comparatively short, a sensitivity also declines, so that the directivity thereof can be made as the cardioid, and if the distance between the front acoustic terminal and the back acoustic terminal becomes comparatively long, a sensitivity for a bi-directivity increases, so that the directivity thereof can be made as the hyper cardioid.

In the condenser microphone of the Japanese Patent Application Publication No. 2007-300268, technical features thereof are that in a state wherein a microphone main body contains nothing in an air chamber provided at a front end portion thereof, in case the condenser microphone unit 100 is attached, the distance between the front acoustic terminal 102 and the back acoustic terminal becomes the longest, and the sensitivity for the bi-directivity increases. Accordingly, the directivity thereof can be made as the hyper cardioid, and if a separately prepared attachment is coaxially disposed inside the air chamber, the distance between the front acoustic terminal 102 and the back acoustic terminal becomes shorter than that in a case of the hyper cardioid, and the sensitivity also declines for that so as to allow the directivity thereof to be the cardioid.

However, in a case of the condenser microphone of the Japanese Patent Application Publication No, 2007-300268, after the attachment is separately prepared, the microphone main body is coaxially disposed inside the air chamber provided at the front end portion thereof so as to be the cardioid, and by removing the attachment, it can be changed to the hyper cardioid. Accordingly, there are inconveniences that a troublesome operation for changing the directivity is required so as to increase the number of members for that, and to raise a cost as well.

In view of the aforementioned problems of a conventional technology, the present invention has an object of providing an electrode extraction terminal for a unidirectional condenser microphone unit which can easily change the directivity thereof into the hyper cardioid by simply applying a sandblast to the small lot member suitable for the cardioid, and a unidirectional condenser microphone unit comprising the electrode extraction terminal.

Further objects and advantages of the invention will be apparent from the following description of the invention.

SUMMARY OF THE INVENTION

The present invention is made in order to attain the aforementioned objects, and main characteristics of the first invention (an electrode extraction terminal) thereof reside in the electrode extraction terminal housed inside a unit case including a front acoustic terminal and a rear acoustic terminal, and contacting with a fixed electrode side forming a unit built-in member of a unidirectional condenser microphone unit so as to extract a current which the fixed electrode generates. The electrode extraction terminal comprises a conductive electrode rod portion including a projection portion at a tip side; and a conductive pedestal portion having a flat surface surrounded by a peripheral wall portion having a sitting height thereof same as that of the projection portion of the electrode rod portion, and facing the fixed electrode under a shape with a size showing a cardioid in a directivity. A surface direction of the conducive pedestal portion is orthogonal to an axis length direction of the electrode rod portion. Also, the conductive pedestal portion includes, at least in a peripheral surface area of the flat surface, one or more sound holes, and a minute concave-convex is formed, i.e. roughened, around the sound hole to reduce an acoustic resistance value to thereby show a hyper cardioid in the directivity.

Also, main characteristics of a second invention (a unidirectional condenser microphone unit) reside in a unit built-in member inside the unit case including the front acoustic terminal and the rear acoustic terminal. The unidirectional condenser microphone unit comprises a vibration plate stretched in a diaphragm ring; a fixed electrode facing the vibration plate by interposing a spacer between the fixed electrode and the vibration plate; the electrode extraction terminal according to the first aspect contacting with the fixed electrode so as to extract a generated current; an insulating body interposed between an outer peripheral side of the peripheral wall portion of the pedestal portion in the electrode extraction terminal and the unit case in such a way as to cover the outer peripheral side of the peripheral wall portion of the pedestal portion in the electrode extraction terminal; a volume reduction filling member disposed inside an air chamber of the unit case by inserting an electrode rod portion in the electrode extraction terminal; and a support ring screwed onto the unit case to press the projection portion against the fixed pole by pressing the volume reduction filling member onto the fixed electrode side. Also, the acoustic resistance value of a sound wave passing through the sound hole included on the flat surface of the pedestal portion is declined through the concave-convex surface so as to show the hyper cardioid in the directivity.

In that case, an acoustic resistance material may be disposed on the flat surface in the pedestal portion. Furthermore, a mesh material can be also disposed between the flat surface in the pedestal portion and the acoustic resistance material.

According to the first aspect of the invention, in the electrode extraction terminal formed as a small lot part showing the cardioid in the directivity, there is provided the concave-convex surface at least in the peripheral surface area of the sound hole provided on the flat surface thereof, so that through the concave-convex surface, the acoustic resistance value of the sound wave passing through the sound hole is declined so as to provide a structure suitable for showing the hyper cardioid as the directivity.

According to the second aspect of the invention, the concave-convex surface is provided at least around the sound hole on the flat surface in the electrode extraction terminal used as the small lot part showing the cardioid in the directivity, and the concave-convex surface is present so as to become substantially equivalent to slightly enlarging a bore diameter of the sound hole to thereby decline the acoustic resistance value of the sound wave passing through the sound hole for that portion, so that the unidirectional condenser microphone unit showing the hyper cardioid as the directivity can be formed.

According to the third aspect of the invention, the acoustic resistance material is disposed on the flat surface so as to allow the acoustic resistance value to decline more reliably.

According to the fourth aspect of the invention, the mesh material is further interposed between the flat surface and the acoustic resistance material so as to allow a declined acoustic resistance value to be stabilized further.

DETAILED DESCRIPTION OF PREFERRED EMBODIMENTS

Figure 1B:
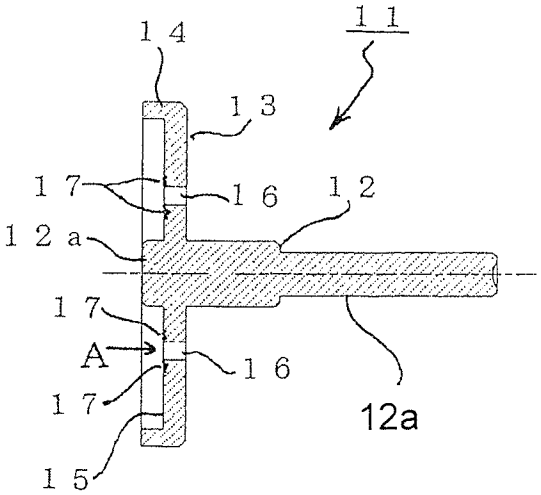
FIGS. 1(*a*) and 1(*b*) are explanatory drawings showing one example of the first invention (an electrode extraction terminal) of the invention, wherein FIG. 1(*a*) shows a front view, and FIG. 1(*b*) shows a right vertical cross-sectional view, respectively.
Figure 1A:
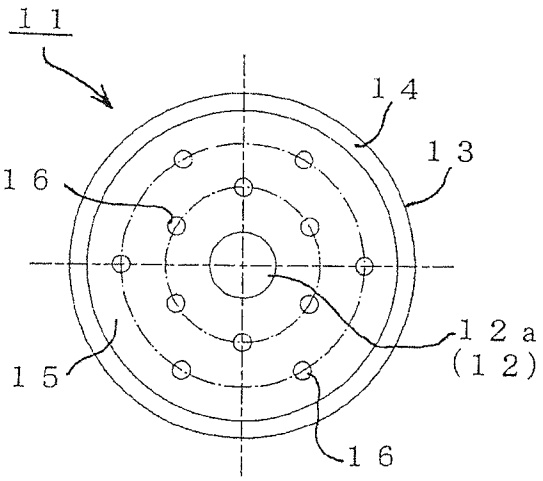
Figure 3B:
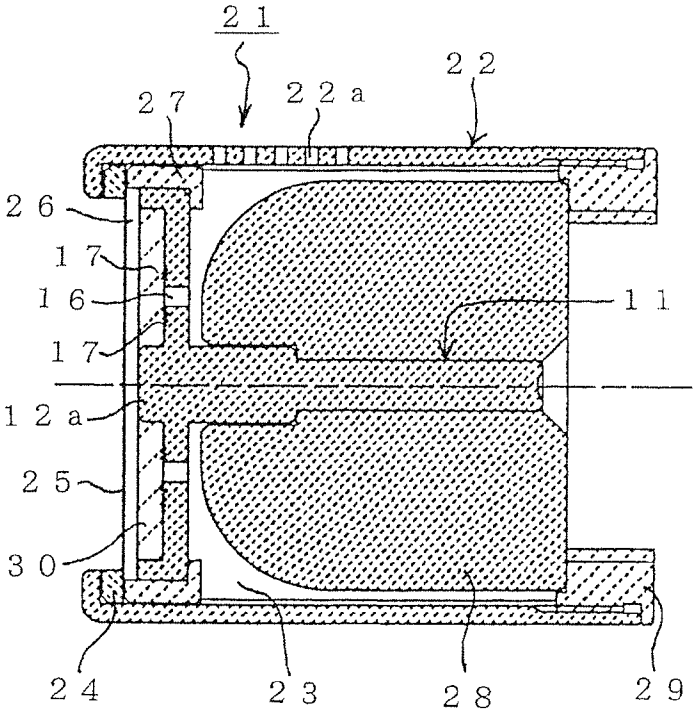
FIGS. 3(*a*) and 3(*b*) are explanatory drawings showing one example of a second invention (a unidirectional condenser microphone unit) of the invention, wherein FIG. 3(*a*) shows a front view whose one portion is omitted, and FIG. 3(*b*) shows a right vertical cross-sectional view whose one portion is omitted, respectively.
Figure 3A:
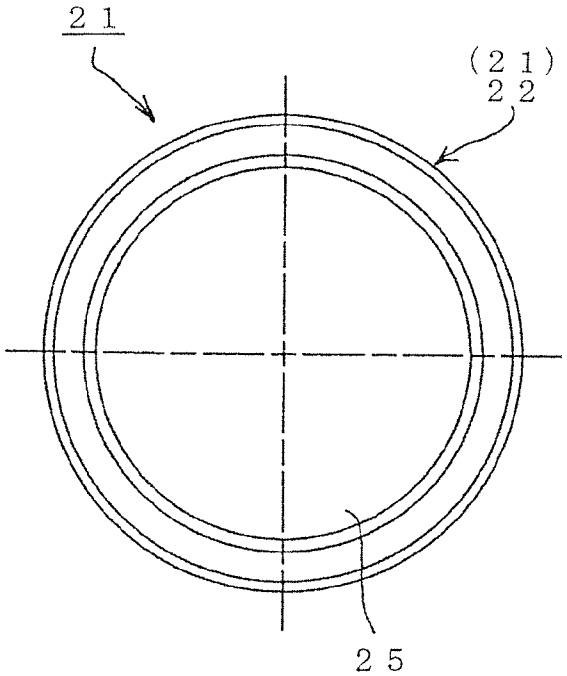

In the present invention, an electrode extraction terminal 11 which is the first invention and shown in FIGS. 1(*a*) and 1(*b*) is housed inside a unit case 22 including a front acoustic terminal (omitted in the drawings) and a rear acoustic terminal 22*a*, and having a cylindrical shape, for example, shown in FIGS. 3(*a*) and 3(*b*), and contacts with a fixed electrode 26 forming a unit built-in member in a unidirectional condenser microphone unit 21 so as to be used as a member for extracting a current from a fixed electrode 26.

Namely, the electrode extraction terminal 11 is formed by an electrode rod portion 12 and a pedestal portion 13, and the electrode rod portion 12 and the pedestal portion 13 are integrally formed by using a conductive metal material such as, for example, brass and the like.

To be more specific based on FIGS. 1(*a*) and 1(*b*), the electrode extraction terminal 11 is integrally formed by the electrode rod portion 12 including a projection portion 12*a* contactable with a center portion of the fixed electrode 26 in FIGS. 3(*a*) and 3(*b*) at a tip side, and having an appropriate length; and the pedestal portion 13 disposing a circular flat surface 15 in such a way that a surface direction thereof is orthogonal to an axis length direction of the electrode rod portion 12. The circular flat surface is surrounded by a circular peripheral wall portion 14 having a sitting height thereof same as that of the projection portion 12*a* of the electrode rod portion 12, and faces the fixed electrode 26 under a shape having an appropriate size showing a cardioid in directivity.

Namely, the electrode extraction terminal 11 is integrally formed in such a way as to have an approximately T shape in a cross-sectional view with an arrangement relation such that an axis direction of the electrode rod portion 12 is located at a center position of the flat surface 15 of the pedestal portion 13, and that the projection portion 12*a* is positioned on the flat surface 15.

Also, for example, as shown in FIG. 1(*a*), on the flat surface 15 of the pedestal portion 13, there is drilled one or appropriate number of sound holes 16 according to needs, such as six sound holes 16 disposed at equal intervals along two concentric circles having different diameters and the like. Incidentally, the sound holes 16 can be formed with a required number at appropriate positions on the flat surface 15, and additionally, the sound holes 16 may be formed with a plurality of numbers at appropriate positions beforehand, and may be used by closing unnecessary sound holes 16 as needed.

Figure 2:
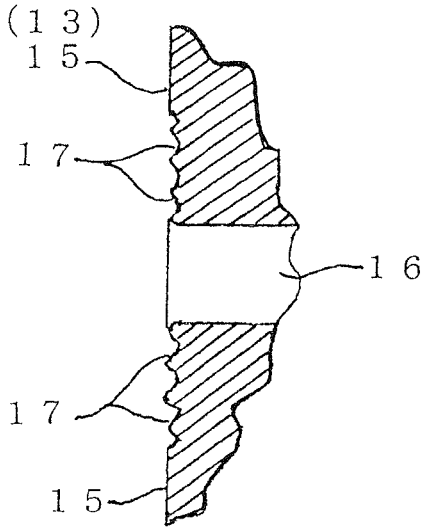
FIG. 2 is a substantial enlarged view of an arrow A portion in FIG. 1(*b*)

Furthermore, on the flat surface 15 positioned at least around the respective sound holes 16, as shown in FIG. 2(*b*), there are provided and roughened minute concave-convex surfaces 17 in a satin pattern to uniformly reduce an acoustic resistance value so that a directivity shows a hyper cardioid. Incidentally, the concave-convex surfaces 17 may be uniformly provided not only around the sound holes 16 but also over a whole surface of the flat surface 15. Also, in that case, the concave-convex surfaces 17 can be formed by a sand-blasting process allowing sand grains having an appropriate particle size to collide against the flat surface 15, and additionally, by an appropriate blasting process allowing other abrasives to collide, or an appropriate etching process.

FIGS. 3(*a*) and 3(*b*) are explanatory drawings showing a configuration example of a unidirectional condenser microphone unit according to a second invention wherein the electrode extraction terminal 11 shown in FIGS. 1(*a*), 1(*b*), 2(*a*), and 2(*b*) is incorporated. According to the figures, the whole unidirectional condenser microphone unit 21 is formed by housing and disposing the unit built-in member including the fixed electrode 26 inside the unit case 22.

Namely, inside the unit case 22 having the cylindrical shape including the front acoustic terminal (omitted in the drawings) on a tip face thereof and the rear acoustic terminal 22*a* on a peripheral side face, there are housed a vibration plate 25 stretched in a diaphragm ring 24 having a circular shape; the fixed electrode 26 having a circular shape and facing the vibration plate 25 by disposing a spacer (omitted in the figures) between the fixed pole 26 and the vibration plate 25; the electrode extraction terminal 11 shown in FIGS. 1(*a*) and 1(*b*) contacting with the fixed electrode 26 so as to extract a generated current; an insulating body 27 having a circular shape and interposed between an outer peripheral side of the peripheral wall portion 14 of the pedestal portion 13 in the electrode extraction terminal 11 and the unit case 22 in such a way as to cover the outer peripheral side of the peripheral wall portion 14 of the pedestal portion 13 in the electrode extraction terminal 11; a volume reduction filling member 28 disposed inside an air chamber 23 of the unit case 22 by inserting an electrode rod portion 12 in the electrode extraction terminal 11; and a support ring 29 screwed on a unit case 22 side to press the projection portion 12*a* against the fixed electrode 26 by pressing the volume reduction filling member 28 onto the fixed electrode 26 side, so that the unidirectional condenser microphone unit 21 is formed.

Furthermore, the unidirectional condenser microphone unit 21 includes the electrode extraction terminal 11 provided with the minute concave-convex surface 17 at least around each sound hole 16 on the flat surface 15 thereof so as to decline the acoustic resistance value such that the directivity thereof shows the hyper cardioid.

In that case, on the flat surface 15 in the pedestal portion 13 of the electrode extraction terminal 11, there may be disposed an acoustic resistance material 30 comprising a compressed sponge and the like in which a sponge (for example, HR50 made in Bridgestone Corporation) is heated and compressed into one fifth so as to decline the acoustic resistance value more reliably, or to further stabilize the acoustic resistance value which is declined by further interposing a mesh material which is not shown in the figures between the flat surface 15 and the acoustic resistance material 30.

Since the present invention is structured in the above-mentioned manner, an operational effect the unidirectional condenser microphone unit 21 according to the second invention has will be explained hereinafter with an operational effect of the electrode extraction terminal 11 according to the first invention.

Namely, regarding the electrode extraction terminal 11 incorporated in the unidirectional condenser microphone unit 21, the concave-convex surface 17 is not formed in a peripheral surface area of the sound hole 16 provided on the flat surface 15 in the pedestal portion 13, and at first, the electrode extraction terminal 11 having a shape with a size showing the cardioid in the directivity is used.

Figure 4:
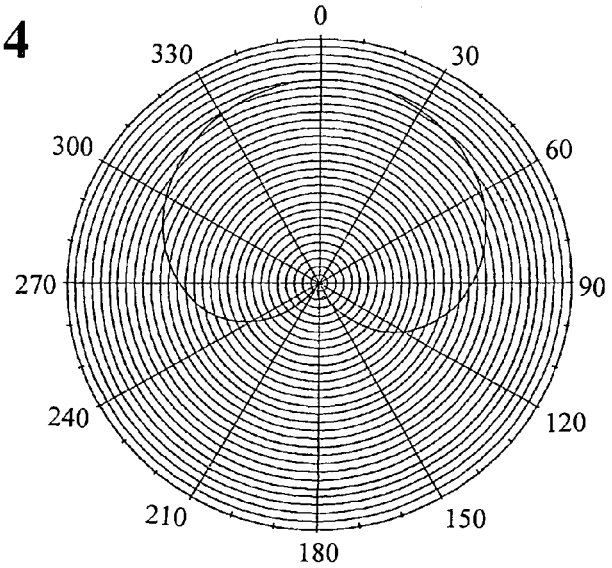
FIG. 4 is a graph showing a frequency response of the unidirectional condenser microphone unit in a case of a cardioid.
Figure 5:
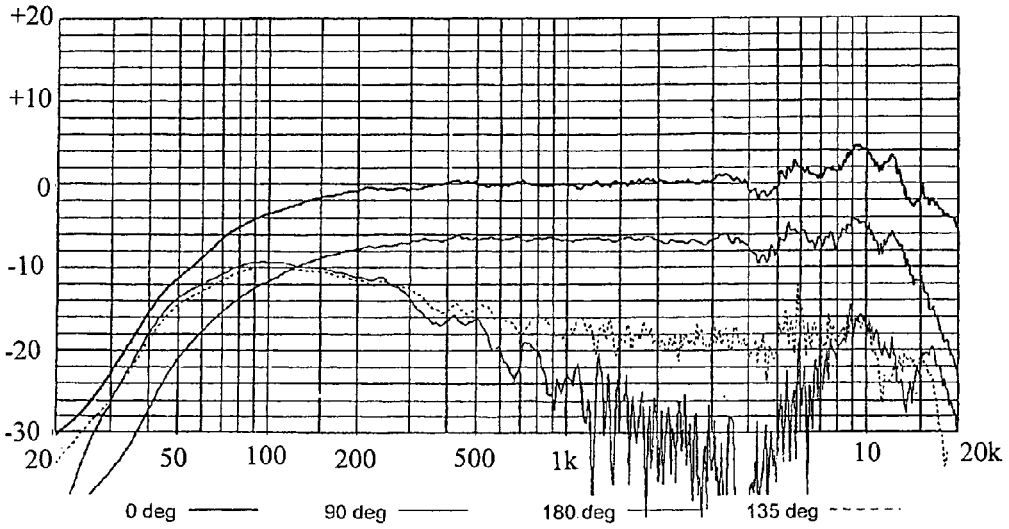
FIG. 5 is a characteristic diagram showing a polar pattern of the unidirectional condenser microphone unit when a directivity is the cardioid.

FIG. 4 is a graph showing a frequency response of the unidirectional condenser microphone unit 21 wherein as the electrode extraction terminal 11 in FIGS. 3(*a*) and 3(*b*), the electrode extraction terminal 11 having the shape with a size showing the cardioid in the directivity without providing the concave-convex surface 17 around the sound hole 16 is incorporated. FIG. 5 is a characteristic diagram showing a polar pattern thereof.

Figure 6:
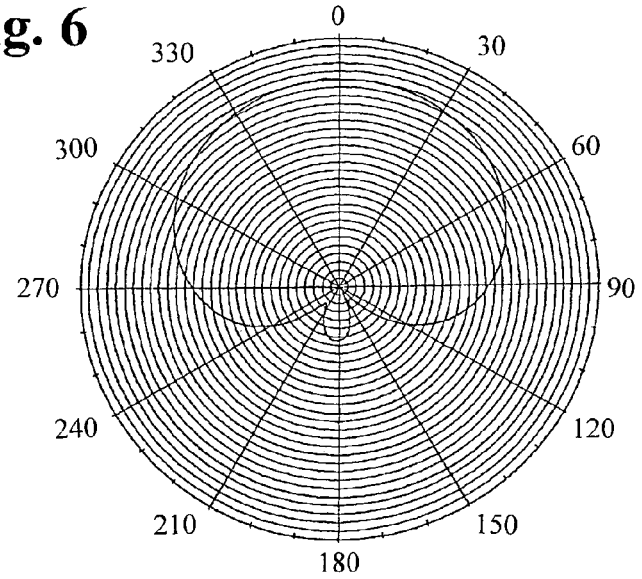
FIG. 6 is a graph showing a frequency response of the unidirectional condenser microphone unit (the second invention) in a case of a hyper cardioid.
Figure 7:
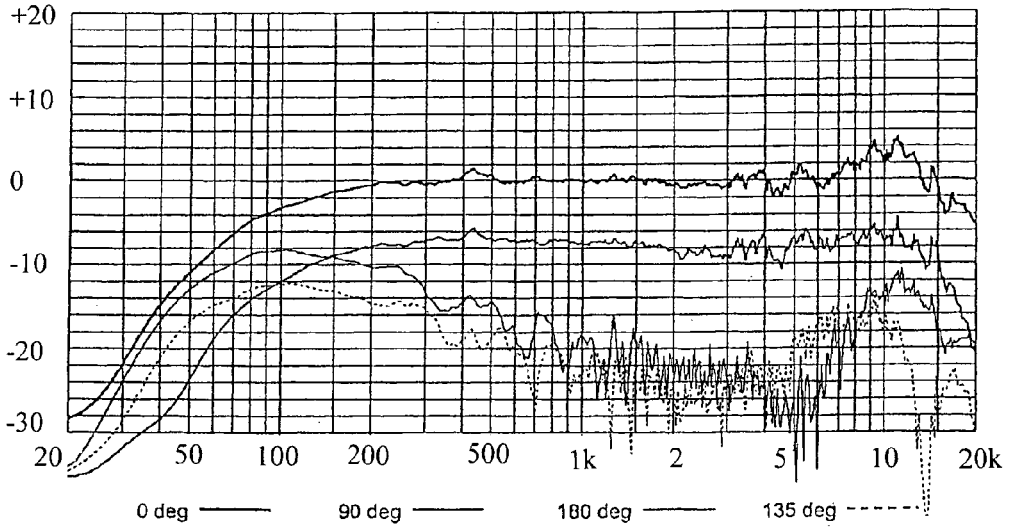
FIG. 7 is a characteristic diagram showing a polar pattern of the unidirectional condenser microphone unit (the second invention) when the directivity is the hyper cardioid.
Figure 8:
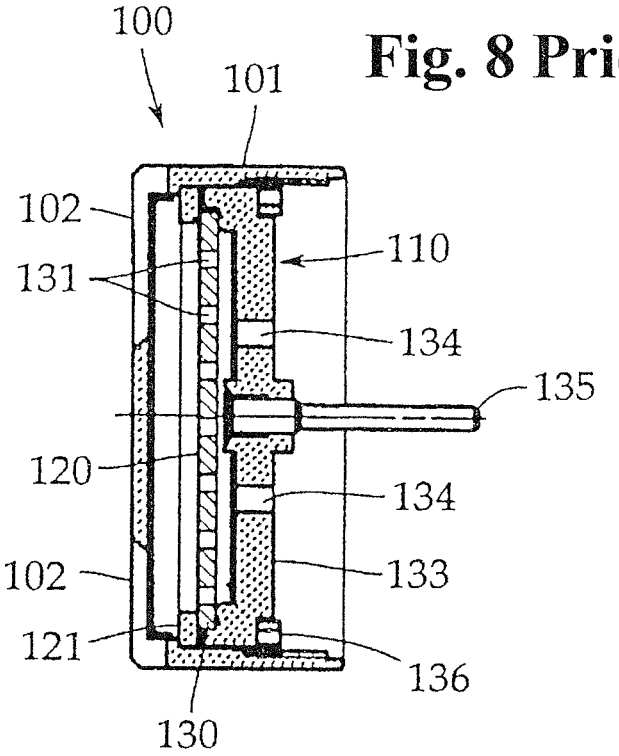
Fig. 8 Prior Art
FIG. 8 is a drawing corresponding to FIG. 3 in Japanese Patent Application Publication No. 2007-300268.

On the other hand, FIG. 6 is a graph showing a frequency response of the unidirectional condenser microphone unit 21 wherein as the electrode extraction terminal 11 in FIGS. 3(*a*) and 3(*b*), the electrode extraction terminal 11 is incorporated, the terminal being provided with the concave-convex surface 17 around the sound hole 16 to allow the acoustic resistance value to decline so as to show the hyper cardioid in the directivity. FIG. 7 is a characteristic diagram showing a polar pattern thereof.

Namely, according to FIG. 4 to FIG. 7, in the unidirectional condenser microphone unit 21, even if the electrode extraction terminal 11 has the shape with a size showing the cardioid in the directivity at first, in case the electrode extraction terminal 11 is incorporated after the concave-convex surface 17 is provided around the sound hole 16, it is obvious to change to the hyper cardioid in the directivity thereof.

Thus, the directivity can be modified from the cardioid to the hyper cardioid, because the concave-convex surface 17 is formed around the sound hole 16 of the flat surface 15 in the pedestal portion 13 of the electrode extraction terminal 11 so as to become substantially equivalent to slightly enlarging a bore diameter of the sound hole 16 and to decline the acoustic resistance value of a sound wave passing through the sound hole 16 for that portion.

Consequently, according to the first invention (the electrode extraction terminal), the electrode extraction terminal 11 formed as a small lot part showing the cardioid in the directivity is provided with the concave-convex surface 17 at least in the peripheral surface area of the sound hole 16 provided on the flat surface 15 thereof. Therefore, by declining the acoustic resistance value of the sound wave passing through the sound hole 16 through the concave-convex surface 17, it is possible to provide a structure suitable for showing the hyper cardioid as the directivity.

Also, according to the second invention (the unidirectional condenser microphone unit), the concave-convex surface 17 is provided at least around the sound hole 16 of the flat surface 15 in the electrode extraction terminal 11 used as the small lot part showing the cardioid in the directivity, and the concave-convex surface 17 is interposed so as to become substantially equivalent to slightly enlarging the bore diameter of the sound hole 16 and to decline the acoustic resistance value of the sound wave passing through the sound hole 16 for that portion, so that the unidirectional condenser microphone unit 21 showing the hyper cardioid as the directivity can be formed.

Also, in a case wherein the acoustic resistance material 30 is disposed on the flat surface 15 of the pedestal portion 13, the acoustic resistance value can be declined more reliably. Moreover, in a case wherein the mesh material which is not shown in the figures is interposed between the flat surface 15 of the pedestal portion 13 and the acoustic resistance material 30, a declined acoustic resistance value can be further stabilized.

The disclosure of Japanese Patent Application No. 2014-003309, filed on Jan. 10, 2014, is incorporated in the application.

While the invention has been explained with reference to the specific embodiments of the invention, the explanation is illustrative and the invention is limited only by the appended claims.

What is claimed is:

1. An electrode extraction terminal to be housed inside a unit case for a unidirectional condenser microphone unit, comprising:

a conductive electrode rod including a projection portion at a tip side; and a conductive pedestal portion integrally formed with the projection portion, and having a flat surface, a peripheral wall surrounding the flat surface and having a sitting height same as that of the projection portion, and at least one sound hole provided in the flat surface to penetrate the conductive pedestal portion, the flat surface being arranged orthogonal to an axis direction of the conductive electrode rod and adapted to face a fixed electrode under a shape and a size showing a cardioid in directivity, wherein the conductive pedestal portion includes a minute concave-convex surface provided in at least a peripheral surface area of the at least one sound hole to reduce an acoustic resistance value so as to show a hyper cardioid in directivity.

2. A unidirectional condenser microphone unit, comprising:

a unit case having acoustic terminals therein;

a diaphragm ring housed in the unit case;

a vibration plate stretched in the diaphragm ring;

a fixed electrode facing the vibration plate;

an electrode extraction terminal contacting with the fixed electrode so as to extract a generated current, the electrode extraction terminal including:

a conductive electrode rod including a projection portion at a tip side; and a conductive pedestal portion integrally formed with the projection portion, and having a flat surface, a peripheral wall surrounding the flat surface and having a sitting height same as that of the projection portion, and at least one sound hole provided in the flat surface to penetrate the conductive pedestal portion, the flat surface being arranged orthogonal to an axis direction of the conductive electrode rod and adapted to face a fixed electrode under a shape and a size showing a cardioid in directivity, wherein the conductive pedestal portion includes a minute concave-convex surface provided in at least a peripheral surface area of the at least one sound hole to reduce an acoustic resistance value so as to show a hyper cardioid in directivity, an insulating body interposed between an outer peripheral side of the peripheral wall of the conductive pedestal portion and the unit case in such a way as to cover the outer peripheral side of the peripheral wall of the conductive pedestal portion in the electrode extraction terminal;

a volume reduction filling member disposed inside an air chamber of the unit case to which a part of the electrode rod is disposed; and a support ring screwed on the unit case to press the projection portion against the fixed electrode by pressing the volume reduction filling member onto the fixed electrode, wherein the acoustic resistance value of a sound wave passing through the at least one sound hole included in the flat surface of the conductive pedestal portion is declined through the concave-convex surface so as to allow the directivity thereof to show the hyper cardioid.

3. A unidirectional condenser microphone unit according to claim 2, further comprising an acoustic resistance material disposed on the flat surface in the pedestal portion.

4. A unidirectional condenser microphone unit according to claim 3, further comprising a mesh material disposed between the flat surface in the pedestal portion and the acoustic resistance material.

5. A unidirectional condenser microphone unit according to claim 2, wherein the vibration plate, fixed electrode, electrode extraction terminal, insulating body, volume reduction filling member and support ring are disposed in the unit case.

6. A unidirectional condenser microphone unit according to claim 2, wherein the minute concave-convex surface includes concave-convex portions formed at an entire portion of the flat surface.

7. A unidirectional condenser microphone unit according to claim 2, wherein the at least one sound hole includes a plurality of first holes arranged coaxially around the projection portion at an equal interval therebetween.

8. A unidirectional condenser microphone unit according to claim 7, wherein the at least one sound hole further includes a plurality of second holes arranged coaxially around the projection portion at an equal interval therebetween radially outside the plurality of first holes such that each of the second hole is located between two of the first holes.

9. An electrode extraction terminal to be housed inside a unit case for a unidirectional condenser microphone unit, comprising:

a solid conductive electrode rod including a projection formed at a front end thereof; and a conductive pedestal having a circular shape and extending annularly from the electrode rod adjacent to a rear end of the projection, the pedestal being integrally formed with the projection portion and having a flat surface arranged orthogonal to an axis direction of the solid conductive electrode, a peripheral wall surrounding the flat surface and having a sitting height same as that of the projection, at least one sound hole provided in the flat surface to penetrate the conductive pedestal portion, and minute concave-convex surfaces provided in at least a peripheral surface area of the at least one sound hole to reduce an acoustic resistance value to show a hyper cardioid in directivity.

* * * * *